US007000603B1

(12) United States Patent
Steenbeke

(10) Patent No.: US 7,000,603 B1
(45) Date of Patent: Feb. 21, 2006

(54) RAPID LOCK AND LOAD PAINTBALL SYSTEM

(76) Inventor: Michael P. Steenbeke, 206 Lyndhurst Pl., San Ramon, CA (US) 94583

( * ) Notice: Subject to any disclaimer, the term of this patent is extended or adjusted under 35 U.S.C. 154(b) by 8 days.

(21) Appl. No.: 10/898,697

(22) Filed: Jul. 22, 2004

Related U.S. Application Data

(60) Provisional application No. 60/489,586, filed on Jul. 22, 2003.

(51) Int. Cl.
*F41B 11/02* (2006.01)

(52) U.S. Cl. ..... 124/45; 124/49

(58) Field of Classification Search ..... 124/45, 124/49, 50, 74
See application file for complete search history.

(56) References Cited

U.S. PATENT DOCUMENTS

| | | | |
|---|---|---|---|
| 1,770,576 | A | 7/1930 | Leather |
| 2,622,771 | A | 12/1952 | Tulou |
| 2,694,515 | A | 11/1954 | Green |
| 2,701,078 | A | 2/1955 | Bowman |
| 3,263,664 | A | 8/1966 | Bauer et al. |
| 4,942,432 | A | 7/1990 | Mort et al. |
| 5,089,854 | A | 2/1992 | Kaieda et al. |
| 5,511,333 | A | 4/1996 | Farrell |
| 5,722,383 | A | 3/1998 | Tippmann, Sr. et al. |
| 5,809,983 | A | 9/1998 | Stoneking |
| 6,055,975 | A | 5/2000 | Gallagher et al. |
| 6,234,157 | B1 | 5/2001 | Parks |
| 6,481,432 | B1 | 11/2002 | Rushton et al. |
| 6,722,355 | B1 | 4/2004 | Andrews, Jr. |
| 6,729,321 | B1 | 5/2004 | Ho |
| 2001/0039945 | A1 | 11/2001 | Rushton et al. |
| 2002/0059927 | A1 | 5/2002 | Woods, Sr. |
| 2003/0154967 | A1 | 8/2003 | Trier et al. |
| 2004/0074488 | A1 | 4/2004 | Ho et al. |

FOREIGN PATENT DOCUMENTS

| | | | |
|---|---|---|---|
| GB | 2 371 352 | A | 7/2002 |
| WO | WO 02/42708 | A1 | 5/2002 |
| WO | WO 03/087697 | A2 | 10/2003 |

*Primary Examiner*—John A. Ricci
(74) *Attorney, Agent, or Firm*—Albert W. Watkins

(57) ABSTRACT

A magazine chamber that is cooperative with existing self-closing refill pods has two longitudinally extending tracks, the first which engages the pod hinge and the second which engages the thumb tab protruding from the cover. The tracks guide the refill pod into the magazine chamber, and once fully inserted, the tracks then rotate the pod about the magazine chamber. This rotation guides the refill pod in a rotation that is differential between the two tracks, with a slight helical offset therebetween. This offset results in longitudinal displacement between thumb tab and pod hinge, effecting an opening of the pod cover and a release of the paintballs held therein into the magazine chamber. Removable covers are provided for the closed end of the magazine chamber that harmlessly deflect longitudinally traveling paintballs. The covers are preferably fabricated with team colors or insignia. Various removable couplers are also disclosed for coupling the magazine to one or more styles of paintball guns.

18 Claims, 5 Drawing Sheets

RAPID LOCK AND LOAD PAINTBALL SYSTEM

CROSS REFERENCE TO RELATED APPLICATIONS

This application claims priority to a U.S. provisional application 60/489,586 filed on Jul. 22, 2003 entitled "Rapid Lock and Load Paintball Loading System," naming the present inventor, and abandoned herewith.

BACKGROUND OF THE INVENTION

1. Field of the Invention

This invention pertains generally to mechanical guns and projectors, and more specifically to the magazines used in paintball guns for holding a supply of paintballs. For the purposes of this disclosure, paintball guns are specifically defined as apparatus that propel paint capsules from a barrel in rapid succession and at relatively high speeds. The paintball capsules are designed to break upon impact with an object or person, thereby rendering an identifiable mark, without injuring the person or object.

2. Description of the Related Art

Paintball guns are designed to preferably be capable of firing, in rapid succession, a relatively large number of paintballs in a short period of time. Firing rates in excess of twenty balls per second are readily available on current models. To support the large demand for paintballs that this rapid firing rate creates, a magazine is provided which stores the paintballs until the balls are delivered to the gun firing chamber. Basic paint ball magazines are little more than large hoppers with a feed tube extending therefrom, a sort of closed funnel through which paint balls are dropped into the firing chamber. The maximum size of the magazine is limited generally by the size of the target which is presented to a competitor, and to the gain in weight and loss in mobility which occur with larger magazines.

A common type of magazine in use is illustrated in U.S. Pat. No. 5,282,454 to Bell et al, the contents which are incorporated herein by reference, which discloses a large magazine with sloping ends and side walls that lead downward to a tubular passageway referred to as a feed tube.

Gravitational forces tend to urge the paint balls to the feed tube, as known in the prior art. The magazine is large, capable of holding many paint balls at a time. The feed tube is connected to the firing chamber of the gun, so that as the paint balls are carried through the tube, they are fed into the firing chamber. A similar magazine with novel powered ball delivery is illustrated by Tippman et al in U.S. Pat. No. 5,722,383, the contents which are additionally incorporated herein by reference.

To keep the size of the magazine within reasonable size ranges, refill containers referred to as pods are provided which contain a store of additional paintballs. Standard pods are configured in the shape of a cylinder, and have a spring loaded cover which holds the balls inside. To reload a typical prior art magazine, the participant will open a closure on the magazine, set the gun down or hold the gun under the arm or between the knees, hold the refill pod with one hand, and pivot the spring-loaded cover with the other hand. Only then can the paintballs be transferred from pod to magazine. This type of transfer requires a great deal of time and attention, and yet still almost always results in a spilling of paintballs.

Quite unlike conventional explosive-propelled munitions, paintballs are relatively round and have an exterior formed from a semi-rigid gelatinous compound. The balls must break with applied forces sufficiently small to prevent harm to a person struck by the ball, and the gelatinous compounds have proven to be successful in this application. The gelatinous compound is, however, known to be affected somewhat by such variables as temperature and relative humidity, and may be sufficiently frangible to fail within the magazine on occasion. In such instance, the participant will often be forced to cease use of the gun, and disassemble and clean the magazine. Removal and replacement of the magazine is often relatively difficult, making this a cumbersome two-handed operation that requires the participant's complete attention. In other words, the participant may be competitively disabled and become an easy target for the competition's shots.

Farrell, in U.S. Pat. No. 5,511,333 incorporated herein by reference, illustrates a magazine less prone to breakage, replaceable, and designed not to jam. Unfortunately, the straight tube design severely limits the number of balls contained within a single magazine. When a rapid fire sequence is initiated, the gun may not jam, but it is highly probably that the magazine will empty, still rendering the gun temporarily disabled.

Another method of providing paintballs is proposed by Miller in U.S. Pat. No. 5,097,816, incorporated herein by reference. Therein, a large helical magazine is provided through which the paintballs pass in a single row, eventually leading to the firing chamber. Unfortunately, the Miller design does not use space efficiently, requiring a large helical path with the center portion thereof unused. The extra dimension is undesirable. The large helical path is substantially more difficult to manufacture, adding cost and reducing yield. Furthermore, because of the reduced slope of the surfaces heading into the firing chamber, actual feed rates may be reduced and paint balls may not be provided at speeds sufficient to meet the needs of the more rapidly firing guns. Cleaning of the Miller construction, which is necessary over time to ensure smooth feeding of the paint balls, and which may still be required should a defective or weak ball break, is very difficult also due to the inaccessibility of the central loops of the helix.

Recognizing the need for improved reload capability, U.S. Pat. No. 6,722,355 by Andrews incorporated herein by reference, proposes a custom pod and magazine. In Andrews, the pod has a rotating door that opens when the pod is mated with the magazine, to release paintballs into the magazine. Unfortunately, the Andrews design requires custom components and so does not work with existing magazines and refill pods. Other custom pods and magazines are similarly proposed by U.S. Pat. No. 6,055,975 by Gallagher et al; U.S. Pat. No. 5,809,983 by Stoneking; U.S. Pat. No. 6,234,157 to Parks; published application 2002/0059927 to Woods; U.S. Pat. No. 6,729,321 by Ho; published application 2004/0074488 by Ho et al; and international application WO03087697 by Ho, the contents of each which are incorporated herein by reference for their teachings. As demonstrated by the recent activity, there is a need for improved loading.

SUMMARY OF THE INVENTION

In a first manifestation, the invention is a rapid lock and load paintball system for operative use in association with a paintball gun. In this manifestation, a standard refill pod has a generally cylindrical body, a cover, a thumb tab protruding from the cover, and a hinge coupling cover to cylindrical body. A magazine has a receiver into which the standard refill pod may be inserted, a guide extending radially about the magazine engaging the refill pod hinge, a guide extending radially about the magazine engaging the refill pod thumb tab, and an outlet for coupling paintballs to the paintball gun. The refill pod hinge guide and refill pod thumb tab guides produce a longitudinal displacement between refill pod thumb tab and refill pod hinge when the refill pod thumb tab is engaged in the refill pod thumb tab guide and the refill pod hinge is engaged in the refill pod hinge guide and the standard refill pod is rotated with respect to the magazine.

In a second manifestation, the invention is a magazine for a paint ball gun. The magazine includes a removable pod with a receptacle, paint balls within the receptacle, and an opening. A receiver encompasses the removable pod circumferentially, and extends longitudinally along therewith. The receiver is open on a first longitudinal end to the removable pod, and closed at a second longitudinal end. The pod is spaced from the receiver second longitudinal end and forms a paintball chamber therebetween. The paintball chamber is larger than the diameter of two paintballs held therein along any directional axis. A receiver outlet extends from the receiver chamber for releasing paintballs into the paintball gun. A means is also provided for agitating the paintballs.

In a third manifestation, the invention is, in combination, a paintball gun magazine suitable for holding paintballs in reserve for firing from a paintball gun extending in a first longitudinal direction and a removable nose cone removably coupled to the paintball gun magazine adjacent a first longitudinal end. The removable nose cone has a surface for deflecting paintballs traveling generally parallel to the longitudinal axis and towards the magazine, while simultaneously preserving a structural integrity of the paintballs.

OBJECTS OF THE INVENTION

Exemplary embodiments of the present invention solve inadequacies of the prior art by providing a uniquely configured magazine which directly couples to standard prior art refill pods and uses the refill pod as one operational component of the magazine during operation. Through the preferred configuration, a simple one-quarter turn engages and opens the pod with the magazine, enabling the operator to refill one-handed, while keeping the second hand on the trigger and ready to fire.

A first object of the invention is to provide a magazine which cooperates with standard refill pods to simply, securely refill, without spill. A second object of the invention is to provide such a magazine having a low profile which does not present an undesirably large target for an opponent. Another object of the present invention is to enable the magazine to be readily coupled to and removed from diverse paintball gun magazine attachments. A further object of the invention is to provide such a magazine which may be refilled with one hand while holding the gun ready for firing with a second hand. An even further object of the invention is to use a refill pod as a significant part of the magazine, so that in the event a ball breaks within the magazine, the pod may be removed along with the paint contaminated pod walls and paintballs. Yet another object of the present invention is to provide a readily removable decorative cover for such a magazine, the cover which may be used to simultaneously provide a limited ability to deflect paintballs and also provide team designations such as unique colors and insignia.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
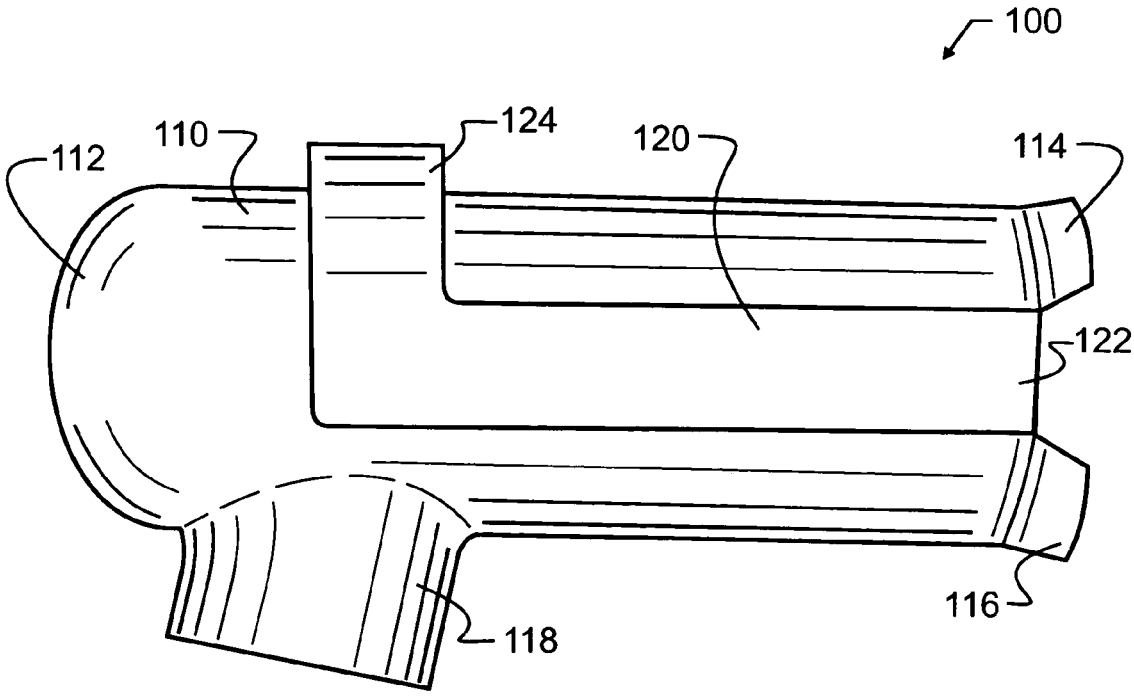
FIG. 1 illustrates a first preferred embodiment paintball gun magazine designed in accord with the teachings of the present invention from a right side plan view.
Figure 2:
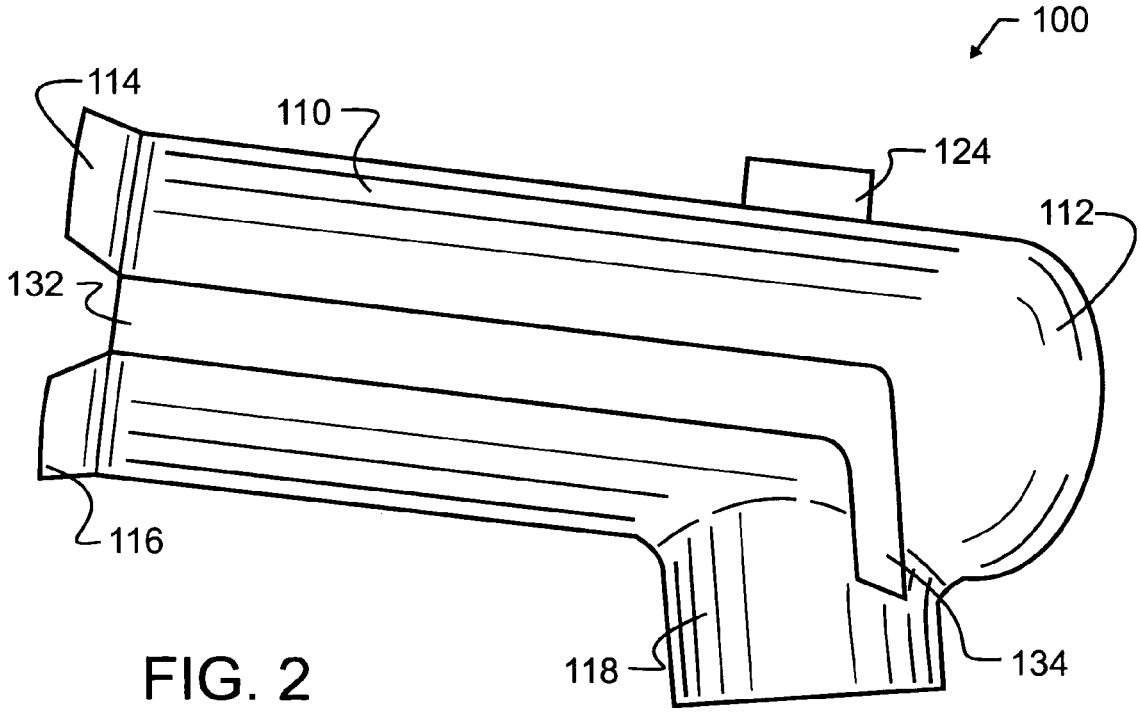
FIG. 2 illustrates the first preferred embodiment paintball gun magazine of FIG. 1 from a left side plan view.
Figure 3:
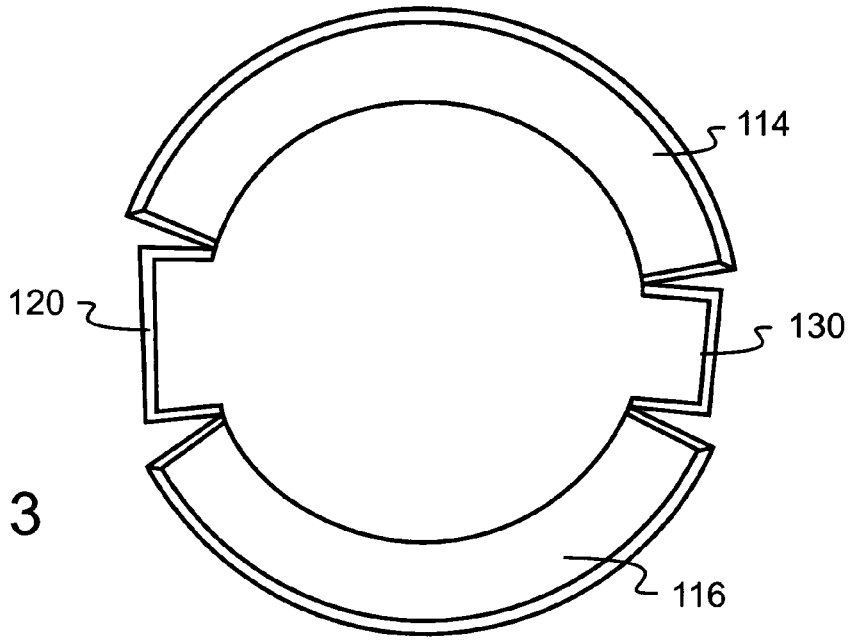
FIG. 3 illustrates the first preferred embodiment paintball gun magazine of FIG. 1 from a simplified end plan view.
Figure 11:
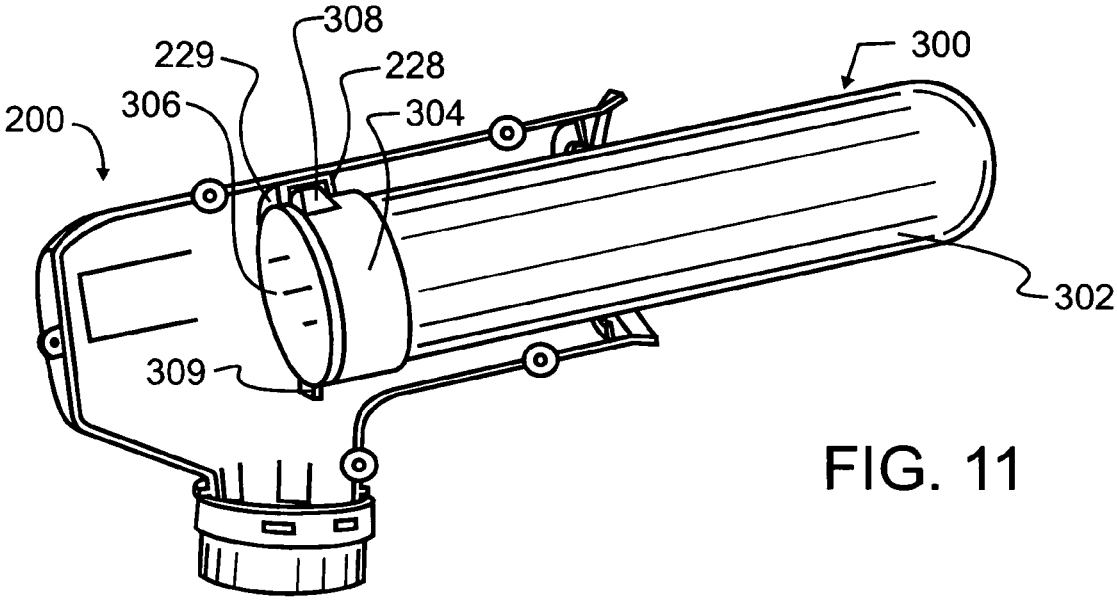
FIG. 11 illustrates the second preferred embodiment paintball gun magazine in further combination with a standard refill pod.

As illustrated in FIGS. 1–3, a first preferred embodiment paintball gun magazine 100 has a generally cylindrical body 110 of inside diameter similar to and slightly greater than that of a standard refill pod, such as pod 300 illustrated in FIG. 11. Cylindrical body 110 is terminated in a first direction by closed end 112 of any suitable geometry, but which in the preferred embodiment is generally hemispherical. Distal to closed end 112 is an inlet defined by tapering inlet guides 114, 116, and pod spring guide 120 and pod thumb tab guide 130.

In operative configuration, a standard pod such as pod 300 of FIG. 11 is inserted into cylindrical body 110 by first aligning pod spring 308 with pod spring guide 120 and pod thumb tab 309 with pod thumb tab guide 130 and then moving pod 300 longitudinally and generally co-axially into cylindrical body 110. Longitudinal spring slide 122 and thumb tab slide 132 act as tracks which guide pod spring 308 and pod thumb tab 309 longitudinally. The furthest insertion is defined by the rotary pod spring guide 124 which extends in a radial arc about the longitudinal center of pod 300 and which terminates longitudinal spring slide 122. When pod spring 308 engages with rotary pod spring guide 124 at the end of longitudinal spring slide 122 distal to tapering inlet guides 114, 116, pod 300 may be inserted no further. At this point, pod thumb tab 309 is similarly engaged with pod thumb tab guide 130 distal to tapering inlet guides 114, 116 and at the start of rotary pod thumb tab guide 134. When longitudinal motion has ceased, pod 300 will then be rotated about the longitudinal axis with respect to cylindrical body 110.

As will be apparent upon close inspection of FIGS. 1 and 2, rotary pod thumb tab guide 134 is not a strictly radial groove, but is somewhat helical about the longitudinal axis of pod 300. In contrast, rotary pod spring guide 124 is radial. Consequently, rotation of pod 300 within cylindrical body 110 will cause pod thumb tab 309 to be displaced longitudinally with respect to pod spring 308. Since pod spring 308 is rigidly supported by cover mount 304 on cylindrical body 302 of pod 300, this differential motion in turn effects an opening of cover 306 from and a release of the paintballs held within the cylindrical body 302 of pod 300. The extra space between rotary pod thumb tab guide 134 and closed end 112 serves as an additional reservoir for balls beyond the reservoir formed by pod 300. This extra space is advantageous, since pod 300 may be removed or inserted one-handedly. During such insertion or removal, it is highly desirable to have some balls in reserve that are available for firing, should the need arise. Since the operator only uses one hand to manipulate pod 300, the other hand may be used to fire paintballs, if required. Most preferably, this extra space will be dimensioned to be larger than the diameter of two paintballs held therein along any directional axis. This size permits the paintballs to accumulate randomly therein in relatively dense arrangement, and avoids the limited storage and other problems found in prior art "single file" feeders such as the Farrell and Miller patents incorporated herein above by reference.

While the first preferred embodiment paintball gun magazine 100 has a low profile with minimal surface exposed to competitor's paintballs, the inventor has recognized that in many cases it will be preferred to present a smooth cylindrical exterior, even if slightly larger. This is because a paintball will, at some angle of impact with the magazine surface, potentially deflect from the magazine without breaking. This deflection can only occur if the surface is smooth, and has no protrusions therefrom. Unfortunately, to keep the overall size at a minimum, the first preferred embodiment paintball gun magazine 100 has protrusions from generally cylindrical body 110 in the form of pod spring guide 120 and pod thumb tab guide 130. Consequently, balls which might otherwise deflect may be broken upon paintball gun magazine 100.

Figure 4:
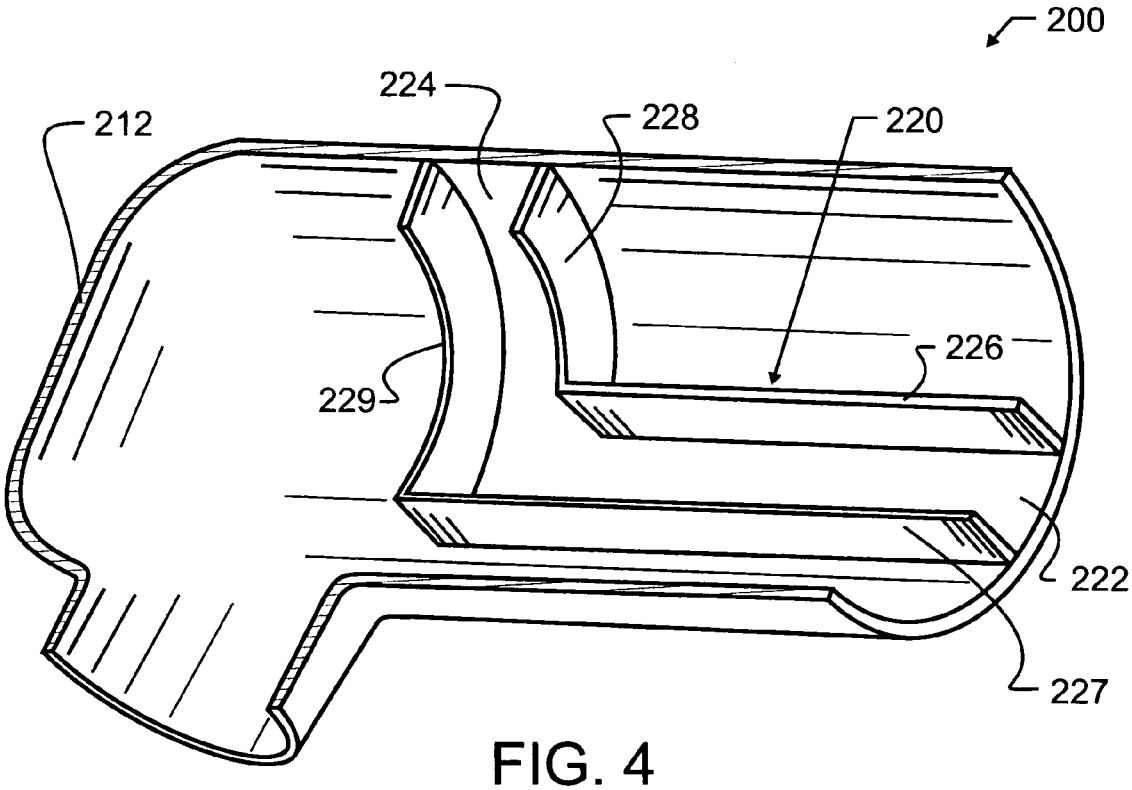
FIG. 4 illustrates the inside right half of a second preferred embodiment paintball gun magazine designed in accord with the teachings of the present invention by partial sectional view.

This issue is resolved in the construction of second preferred embodiment paintball gun magazine 200, though at the cost of slightly larger overall dimension. In order to maintain a smooth exterior surface, protrusions are provided internal of the external wall which serve as guides. For exemplary purposes, pod spring guide 220 is illustrated in FIG. 4 which serves as the functional equivalent of pod spring guide 120, though it will be understood that a pod thumb tab guide would also be constructed using the same technique to act as the functional equivalent of pod thumb tab guide 130. As can be seen in FIG. 4, two separate guide walls form pod spring guide 220. The first section, longitudinal spring slide 222, is demarcated by walls 226 and 227. The second section, rotary pod spring guide 224, is demarcated by walls 228 and 229.

From the illustrations and foregoing discussion of the first and second preferred embodiment paintball gun magazines 100, 200, it should be apparent that different locating systems may be used to cause longitudinal pod thumb tab 309 to be displaced longitudinally with respect to pod spring 308, and that the first and second preferred embodiments are but two of the most preferred techniques. Other such techniques are considered to incorporated herein, as will be recognized by those skilled in the art upon a review of the present disclosure. As but one example, and not limited thereto, it is not necessary that rotary pod spring guides 124, 224 extend only radially, and these guides may include some longitudinal displacement of pod 300 also. In such case, however, rotary pod thumb tab guides 134, 234 will need to include more longitudinal displacement than that of rotary pod spring guides 124, 224. The guides will then, upon rotation, preferably ensure a differential between the two guides, with a slight helical offset therebetween.

Figure 5:
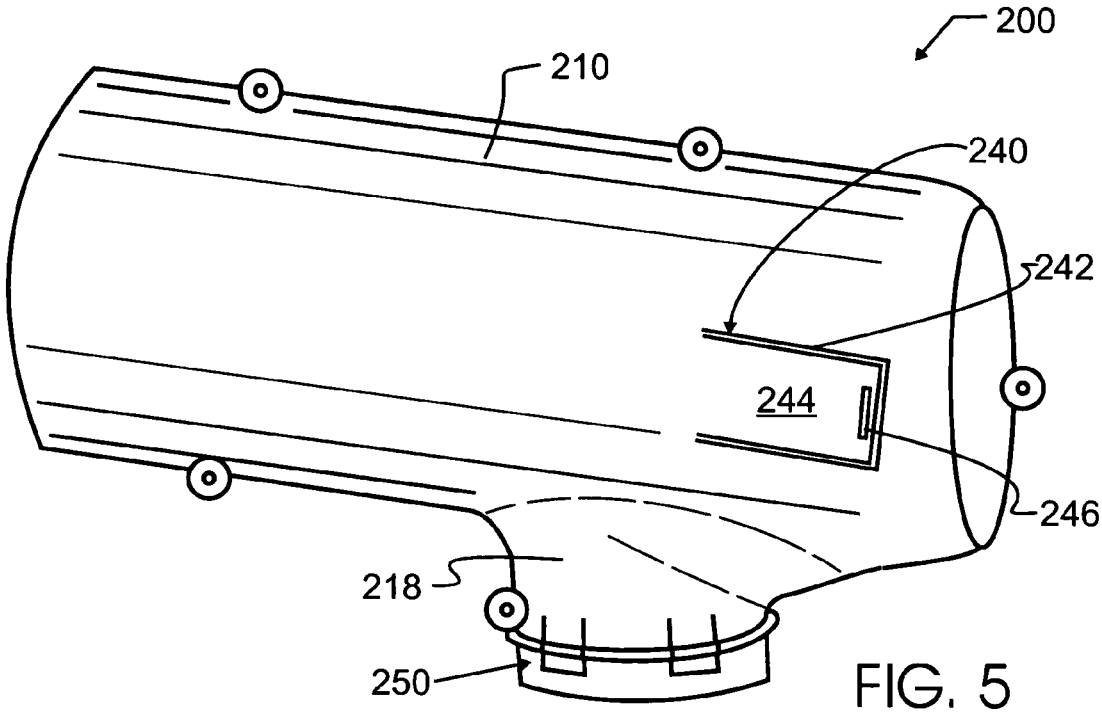
FIG. 5 illustrates the second preferred embodiment paintball gun magazine of FIG. 4 from a left side plan view.

FIG. 5 illustrates additional preferred coupling features that may be used with either the first or second preferred embodiment paintball gun magazines 100,200, though illustrated in combination with the second preferred embodiment paintball gun magazine 200 of FIG. 4. As illustrated therein, one or more nose cone connection tabs 240 may preferably be provided adjacent closed end 212 which act to receive one of the plurality of interchangeable nose cones described herein below. To effect quick release and replacement thereof, tabs 240 are provided which preferably consist of a small u-shaped groove 242 formed into cylindrical body 210. This leaves a cantilever spring 244, which, at the end thereof, includes a ridge or protrusion 246 suitable for mating in a small notch or the like within a nose cone.

Figure 6:
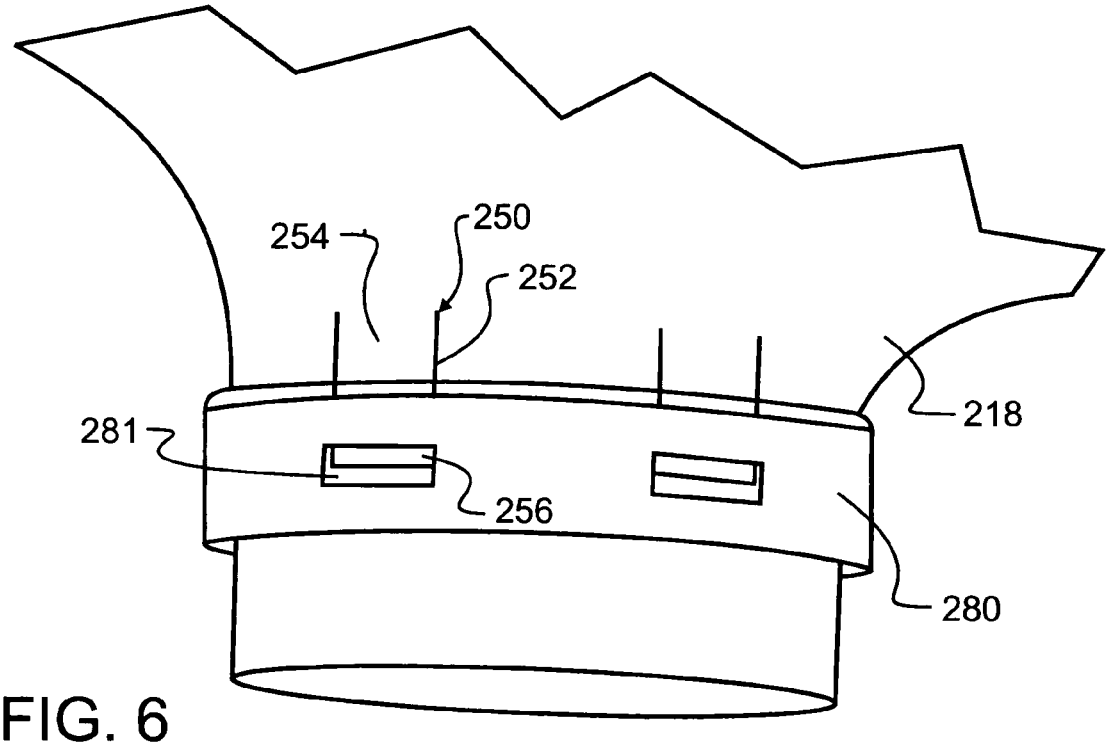
FIG. 6 illustrates the preferred coupling to a paintball gun used in the second preferred embodiment paintball gun magazine of FIG. 5, from a magnified view.

In similar manner, FIG. 6 illustrates readily interchangeable coupling to a paintball gun used in preferred embodiment paintball gun magazines 100, 200. One or more gun connection tabs 250 may preferably be provided adjacent magazine outlet 218, which act to couple to one or more appropriate gun couplers, such as gun coupler 280 illustrated herein or coupler 270 illustrated in FIG. 7. To effect quick release and replacement thereof, tabs 250 are provided which preferably consist of a small u-shaped groove 252 formed into magazine outlet 218. This leaves a cantilever spring 254, which, at the end thereof, includes a ridge or protrusion 256 suitable for mating in a small notch 281 or the like within gun coupler 280.

Figure 7:
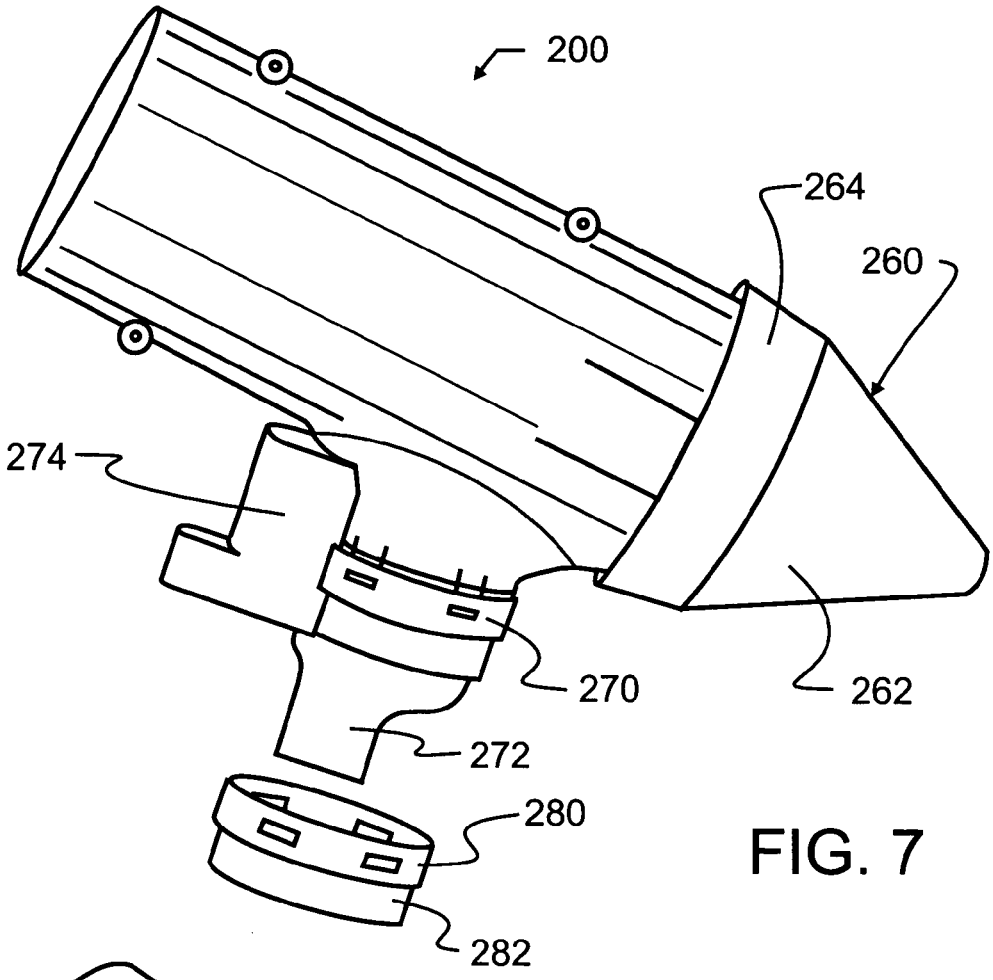
FIG. 7 illustrates the second preferred embodiment paintball gun magazine of FIG. 5 from a left side plan view and in further combination with a preferred replaceable cone and demonstrating several alternative paintball gun couplings.

FIG. 7 illustrates the second preferred embodiment paintball gun magazine 200 in further combination with preferred replaceable cone 260 and demonstrating several alternative paintball gun couplers 270,280. Replaceable cone 260 includes a generally conical top 262 and a mating ring 264 designed to engage with protrusions 246. Mating ring 264 may use notches, but may alternatively have a small ring or ridge formed on the inside diameter thereof which may, for exemplary purposes only and not limited thereto, have a gentle slope of decreasing diameter from the open end towards the conical top 262, followed by a sudden increase in diameter subsequent thereto. This creates the well known flares or flanges, which will readily slip over protrusions 246 when being pressed in place, and yet which will resist removal therefrom. In order to remove cone 260, an operator will preferably press against cantilever spring 244, which in turn will retract protrusion 246 from engagement with mating ring 264, while pulling cone 260 longitudinally away from cylindrical body 210.

The use of a removable nose cone creates an additional opportunity and advantage in the present invention. In the event a paintball should break inside of pod 300 or in the other parts of the magazine during competition, pod 300 may be removed therefrom for rapid replacement.

Additionally, if the end of generally cylindrical body 110,210 is open adjacent to nose cone 260, and nose cone 260 therefore acts as the closure for this end of body 110, 210, then nose cone 260 may additionally be removed. By removing both nose cone 260 and pod 300, the participant may readily clean out body 110, 210 and quickly return to competition. The use of tabs 250 permits paintball gun couplers of various geometries and with various functions to be used in association with the present invention. As illustrated in FIG. 7, one suitable coupler 270 may be provided which can include such components as agitator motors, battery packs, and the like in auxiliary region 274, that in turn assist with the dispensing of paintballs at outlet 272.

Coupler 270 is preferably dimensioned to be compatible with a variety of prior art paintball guns, and will furthermore be dimensioned to satisfy the needs of most any gun which receives paintballs directly into the breach or some firing tube inlet. One type of gun includes a star feed within the gun body, and will then require a larger outlet 282 provided by coupler 280, which would be used instead of coupler 270.

Figure 8:
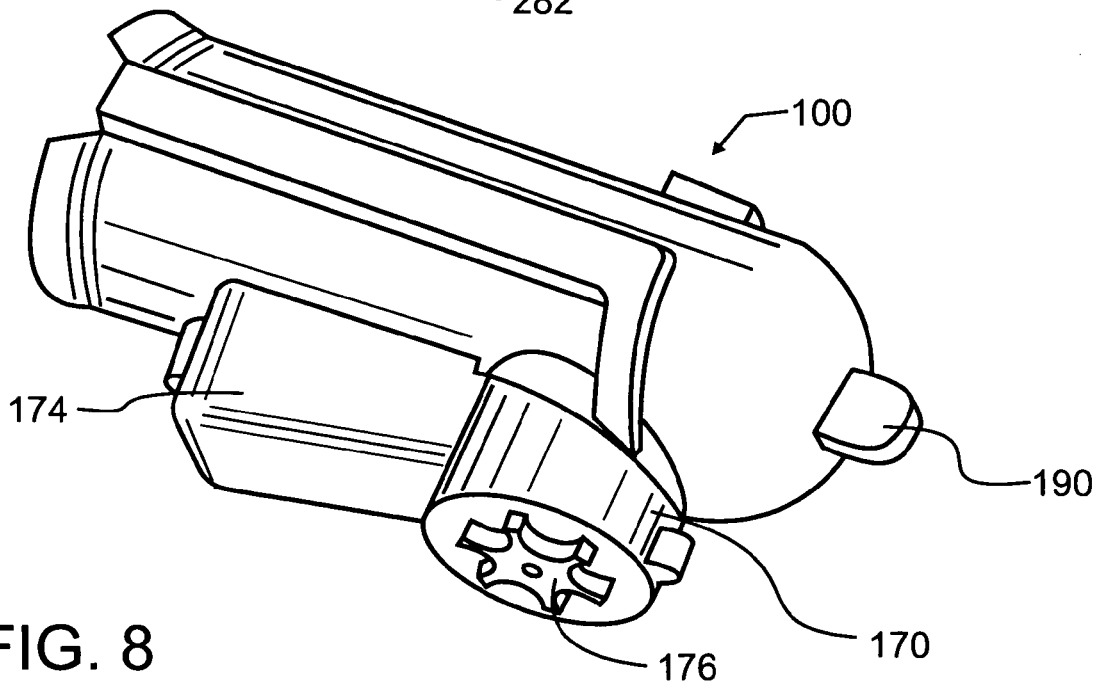
FIG. 8 illustrates the first preferred embodiment paintball gun magazine of FIG. 1 from a projected view and in further combination with an alternative paintball gun coupling and agitator.

FIG. 8 illustrates the first preferred embodiment paintball gun magazine 100 of FIG. 1 in further combination with an alternative paintball gun coupling and agitator 170, including a source of motive power 174 and ball feeding gear 176. As should be apparent, FIGS. 7 and 8 effectively illustrate the many types of components that may be readily attached to the preferred embodiment magazines 100, 200.

Figure 9:
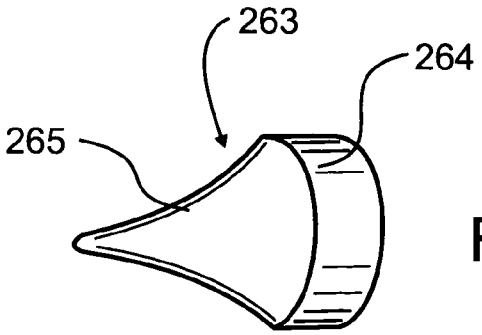
FIG. 9 illustrates a first alternative embodiment replaceable cone usable in association with the preferred embodiment paintball gun magazines.
Figure 10:
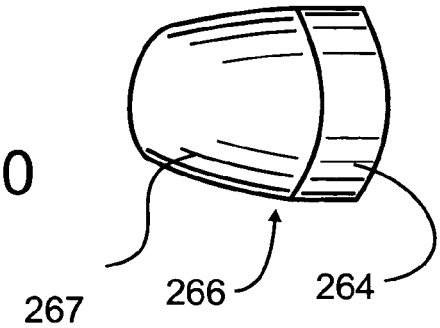
FIG. 10 illustrates a second alternative embodiment replaceable cone usable in association with the preferred embodiment paintball gun magazines.

FIGS. 9 and 10 illustrate two alternative embodiment replaceable cones 263, 266 usable in association with the preferred embodiment paintball gun magazines. Cone 263 has a convex conical top 265, while cone 266 has a concave conical top 267. Both use a mating ring 264 similar to cone 260. The preferred cone 260 and alternative cones 263, 266 may be fabricated from different colors and may include various ornamentations such as, but not limited to team insignia and the like. In one conceived of embodiment, the removable cones 260,263,266 may be vacuum formed in volume and so be of low cost and ready replacement, though the method of fabrication and specific geometries are not critical herein, so long as the operational characteristics are preserved. On such characteristic which is highly desired is an ability to deflect paintballs traveling parallel or nearly parallel to the longitudinal axis of the magazine, and another characteristic which is desirable is the ability to identify teams during competition.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A rapid lock and load paintball system for operative use in association with a paintball gun, comprising:

a standard refill pod having a generally cylindrical body, a cover, a thumb tab protruding from said cover, and a hinge coupling said cover to said generally cylindrical body; and a magazine having a receiver into which said standard refill pod may be inserted, a guide extending radially about said magazine engaging said refill pod hinge, a guide extending radially about said magazine engaging said refill pod thumb tab, and an outlet for coupling to said paintball gun;

said refill pod hinge guide and said refill pod thumb tab guides producing a longitudinal displacement between said refill pod thumb tab and said refill pod hinge when said refill pod thumb tab is engaged in said refill pod thumb tab guide and said refill pod hinge is engaged in said refill pod hinge guide and said standard refill pod is rotated with respect to said magazine.

2. The rapid lock and load paintball system of claim 1 wherein said refill pod hinge guide and said refill pod thumb tab guide are helically offset to produce said longitudinal displacement therebetween.

3. The rapid lock and load paintball system of claim 2 wherein said refill pod hinge guide and said refill pod thumb tab guide each further comprise longitudinal guide sections prior to said helical offset.

4. The rapid lock and load paintball system of claim 1 wherein said standard refill pod effects a closure of said receiver to a passage of paintballs when inserted into said receiver, and effects an opening of said receiver to said passage of paintballs when removed therefrom.

5. The rapid lock and load paintball system of claim 1 wherein said magazine further comprises a chamber space between said pod and said outlet.

6. The rapid lock and load paintball system of claim 1 further comprising a nose cone removably attached to said magazine and removable therefrom, said nose cone having a geometry suitable for increasing a probability of deflection of intact paintballs from said magazine.

7. The rapid lock and load paintball system of claim 6 wherein said magazine further comprises cantilevered nose cone interlocking members.

8. The rapid lock and load paintball system of claim 1 further comprising a gun coupling removably attached to said magazine and removable therefrom.

9. The rapid lock and load paintball system of claim 8 wherein said magazine further comprises cantilevered gun coupler interlocking members.

10. A magazine for a paint ball gun, comprising in combination:

a removable pod having a receptacle, paint balls within said receptacle, and an opening;

a receiver for encompassing said removable pod circumferentially, and extending longitudinally along therewith, said receiver open on a first longitudinal end to said removable pod and closed at a second longitudinal end, said pod spaced from said second longitudinal end and forming a paintball chamber therebetween larger than the diameter of two paintballs held therein along any directional axis;

a receiver outlet extending from said receiver chamber; and a means for agitating paintballs.

11. The magazine for a paint ball gun of claim 10 wherein said removable pod has a self-closing cover closing said opening, a coupling to said receptacle, and a coupling to said self-closing cover.

12. The magazine for a paint ball gun of claim 11 further comprising a guide extending radially about said receiver engaging said coupling to said receptacle, and a guide extending radially about said receiver engaging said coupling to said self-closing cover.

13. The magazine for a paint ball gun of claim 10 wherein said agitating means further comprises a removable coupling to said receiver.

14. The magazine for a paint ball gun of claim 10 wherein further comprising a removable nose cone comprising a surface for deflecting paintballs traveling generally parallel to said longitudinal axis and towards said receiver, while simultaneously preserving a structural integrity of said paintballs.

15. In combination, a paintball gun magazine suitable for holding paintballs in reserve for firing from a paintball gun extending in a first longitudinal direction and a removable nose cone removably coupled to said paintball gun magazine adjacent a first longitudinal end of said paintball gun magazine, said removable nose cone comprising a surface for deflecting paintballs traveling generally parallel to said longitudinal axis and towards said magazine, while simultaneously preserving a structural integrity of said paintballs.

16. The combination paintball gun magazine and removable nose cone of claim 15 wherein said removable nose cone further comprises a unique team color.

17. The combination paintball gun magazine and removable nose cone of claim 15 wherein said removable nose cone further comprises a unique team indicia.

18. The combination paintball gun magazine and removable nose cone of claim 15 further comprises cantilevered nose cone interlocking members retaining said nose cone to said paintball gun magazine.

* * * * *